US006121563A

United States Patent [19]

Hochgesang et al.

[11] Patent Number: 6,121,563

[45] Date of Patent: Sep. 19, 2000

[54] LARGE KEY COVERING SEVERAL SMALL KEY FIELDS FOR A KEYBOARD

[75] Inventors: Gerhard Hochgesang; Klaus Schmoeger, both of Bad Neustadt, Germany

[73] Assignee: Preh-Werke GmbH & Co. KG, Bad Neustadt/Saale, Germany

[21] Appl. No.: 09/264,712

[22] Filed: Mar. 9, 1999

[30] Foreign Application Priority Data

Mar. 14, 1998 [DE] Germany ..... 198 11 230

[51] Int. Cl.[7] ..... H01H 13/70

[52] U.S. Cl. ..... 200/343; 200/344

[58] Field of Search ..... 200/343, 344

[56] References Cited

U.S. PATENT DOCUMENTS

| | | | |
|---|---|---|---|
| 4,902,862 | 2/1990 | Oelsch et al. | 200/344 |
| 5,201,824 | 4/1993 | Kato et al. | 200/520 |

FOREIGN PATENT DOCUMENTS

| | | |
|---|---|---|
| 0 412 033 A1 | 2/1991 | European Pat. Off. . |
| 33 29 698 A1 | 3/1985 | Germany . |
| 37 19 839 C1 | 10/1988 | Germany . |

*Primary Examiner*—Michael L. Gellner
*Assistant Examiner*—Nhung Nguyen
*Attorney, Agent, or Firm*—Birch, Stewart, Kolasch & Birch, LLP

[57] ABSTRACT

A large key covering several small key fields of a keyboard has a bearing fork projection (9), lever arms (10 and 11) of which each have an bearing pin (12) that engages a grip slot located in each side of an adjacent guide bush pair (14), with a key ram (5) of the large key ram including a clip collar (16) which, when the large key is pivoted to extend the key ram into a guide bush (6) of the guide body (3), snaps over a protrusion ledge (15) in the guide bush. The large key provides an arrangement that is easy to install, is structured as a single piece, and allows for simple verification of assembly; unlike known large keys covering several small key fields which comprise several parts and are difficult to mount.

5 Claims, 3 Drawing Sheets

12
13
6
14
10
9
2
22
16
7
8
4
5
21
6
15
3

LARGE KEY COVERING SEVERAL SMALL KEY FIELDS FOR A KEYBOARD

BACKGROUND OF THE INVENTION

This invention relates to a large key covering several small key fields for a keyboard arranged on a guide body of the keyboard for actuating switching contacts, including a switching foil, via a switching dome of the keyboard, wherein the guide body includes a guide bush and the large key includes a key ram for engaging in the guide bush and cooperating with the switching dome and the switching foil positioned under the guide body.

German patent document (DE 33 29 698 A1) discloses such a key, in which it is disclosed that: some keys on keyboards are rather larger than other keys and are large in relation to contacts to be actuated. In order to prevent jamming in a case of off-center actuation, two scissor-type flat stays are provided as guide elements. Their two axes are kept in alignment with each other. Four bearings of upper free ends of arms surround a rectangular surface, which is covered for the most part by an actuation surface, resulting in a concealed assembly.

European patent document (EP 0 412 033 A1) discloses a method of reinforcing a key with a pair of arms connected by a connection shaft, with the arms being arranged underneath the key.

In order to facilitate mounting, German patent document (DE 37 19 839 C1) recommends that a guide element be held by a notched device in a rest position, in which stop devices on the guide element are positioned in front of grip slots. When a key is pressed, the guide element moves into its operating position. In this manner, the stop devices are directed into the grip slots. then are set back down in such a way that a different contact is actuated. In so doing, incorrect engagement of a lead-in area can cause a grip slot to become deformed and the entire device to become unusable.

Therefore, it is an object of the invention to provide measures for use with a key device of the type set forth in the opening paragraph above, that prevents deformation of a grip slot as well avoiding a concealed assembly.

SUMMARY

According to principles of this invention a large key has a bearing fork projection extending to a side of the key, the bearing fork projection including lever arms each of which has a bearing pin for engaging a grip slot in a guide body of a keyboard, there being a grip slot positioned on both sides of an adjacent guide bush pair, a key ram of the large key including a clip collar so that when the large key is rotated to telescope the key ram into the guide bush the clip collar snaps over a protrusion ledge in the guide bush.

BRIEF DESCRIPTION OF THE DRAWING

The invention is described and explained in more detail below using an embodiment shown in the drawings. The described and drawn features can be used individually or in preferred combinations in other embodiments of the invention. The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
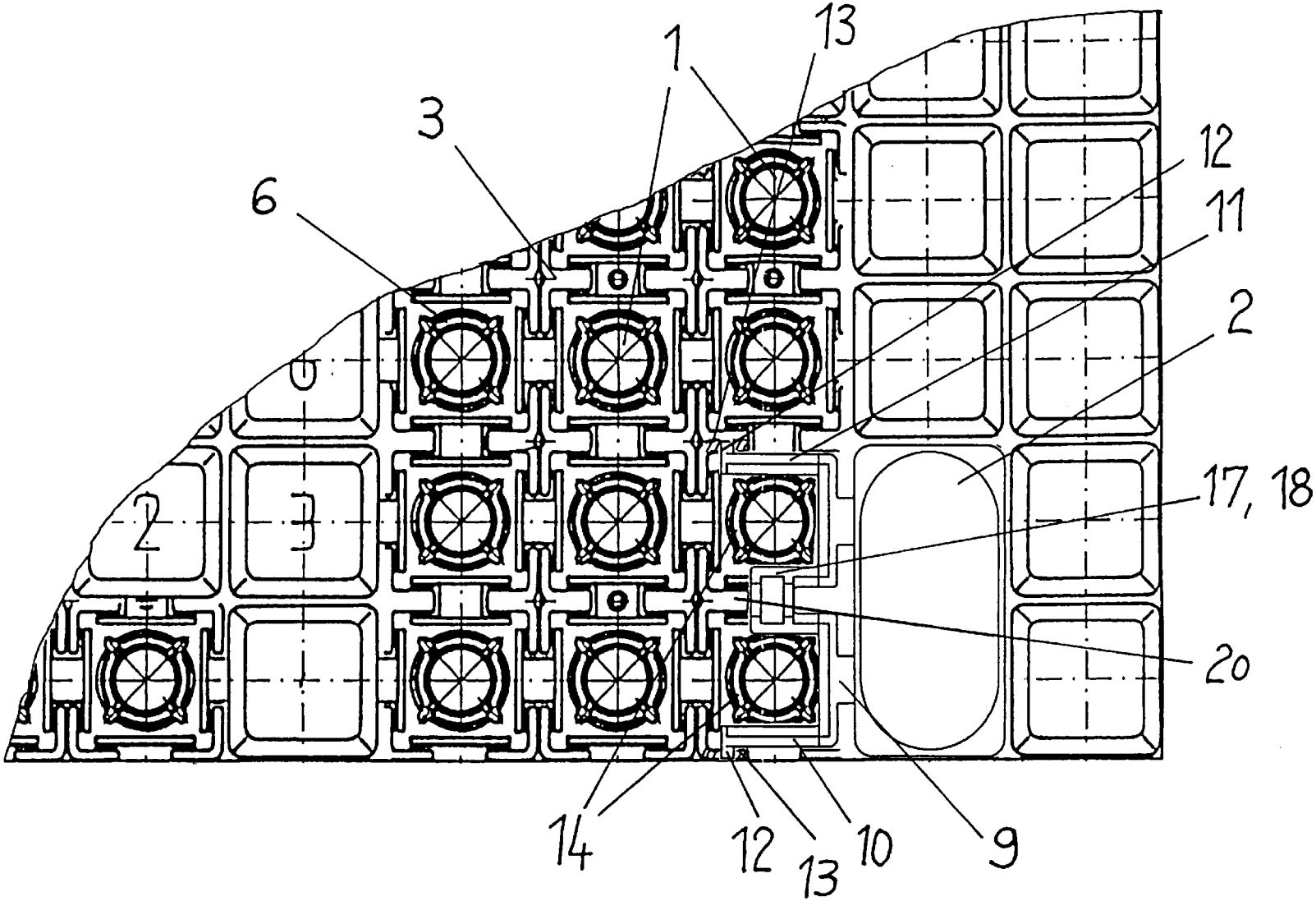
FIG. 1 is a top view of a segmented keyboard showing a large key covering several small key fields of the keyboard.
Figure 2:
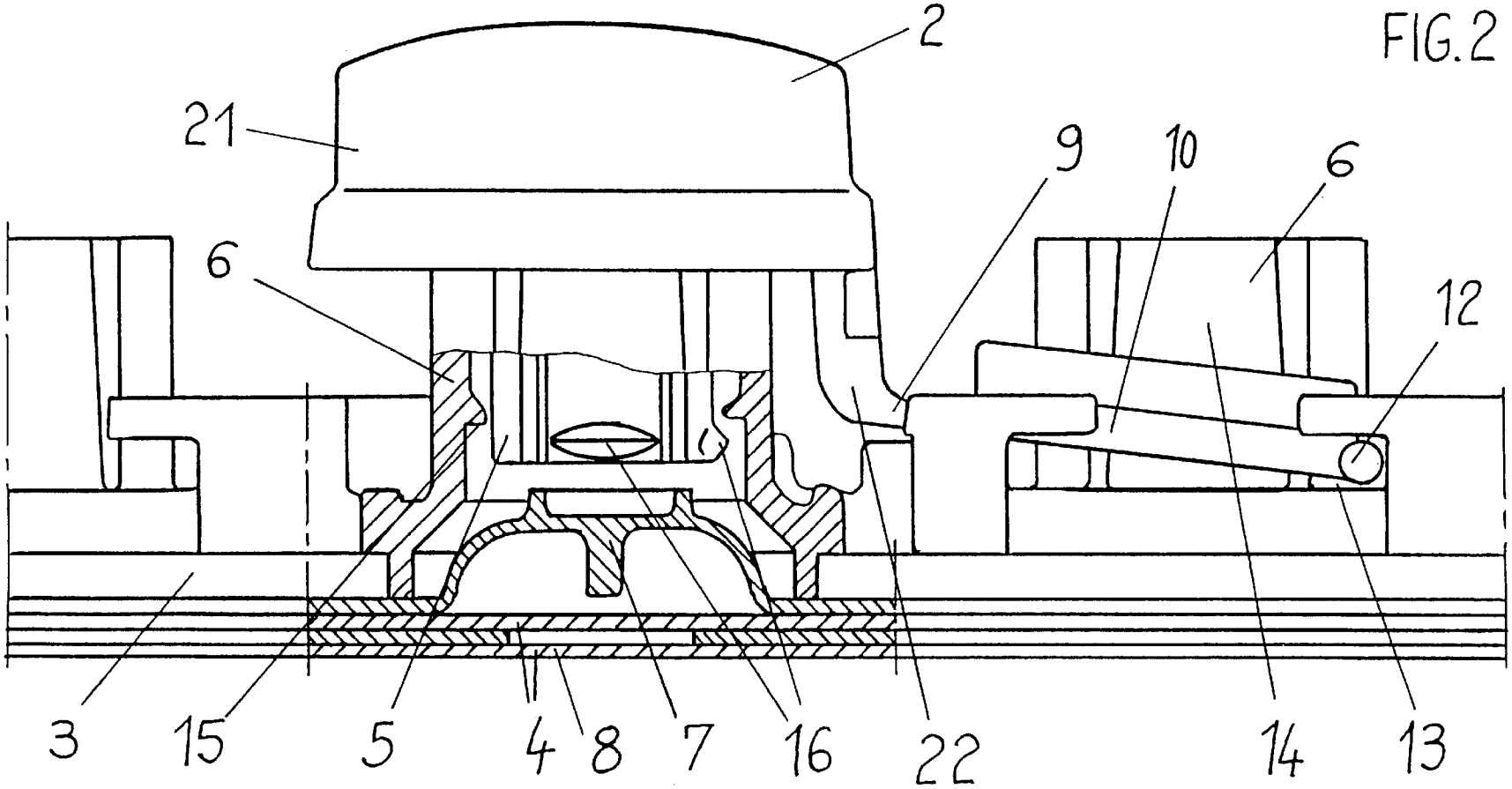
FIG. 2 is an enlarged side, partially sectional, view of a segment of the keyboard of FIG. 1, including the large key.
Figure 6:
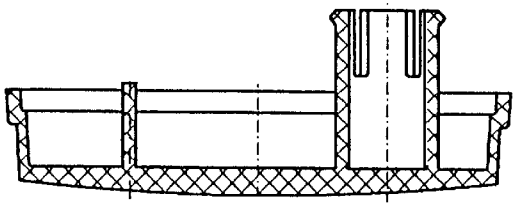
FIGS. 5, 6, and 7 are sectional views of the large key respectively taken on lines V—V, VI—VI, and VII—VII in FIG. 3.

FIG. 1 shows a large key 2 covering several small key fields 1 for a keyboard in an arrangement on a guide body 3 for actuating switching contacts 4, with a key ram 5 passing through a guide bush 6 arranged on the guide body 3 and with a switching dome 7, cooperating with a switching foil 8 positioned under the guide body 3, as can be seen from FIG. 2, in which a side view of FIG. 1 is shown as a partial cutaway view in an area of the guide bush 6. The key 2 has a bearing fork projection 9, each lever arm 10 and 11 of which has a bearing pin 12 that engages in a grip slot 13 in the guide body 3, each grip slot, as can also be seen in FIG. 2, being at an opposite side of a first adjacent guide bush pair 14. Alternatively, however, an embodiment for a larger key can be provided in which guide slots at a second adjacent guide bush pair are used. In both arrangements, it is provided that a spring clip collar 16 of the key ram 5, which is pivoted into the guide bush 6, snaps over a protrusion ledge 15. In this manner, the key 2 is kept firmly attached to the guide body 3.

Figure 3:
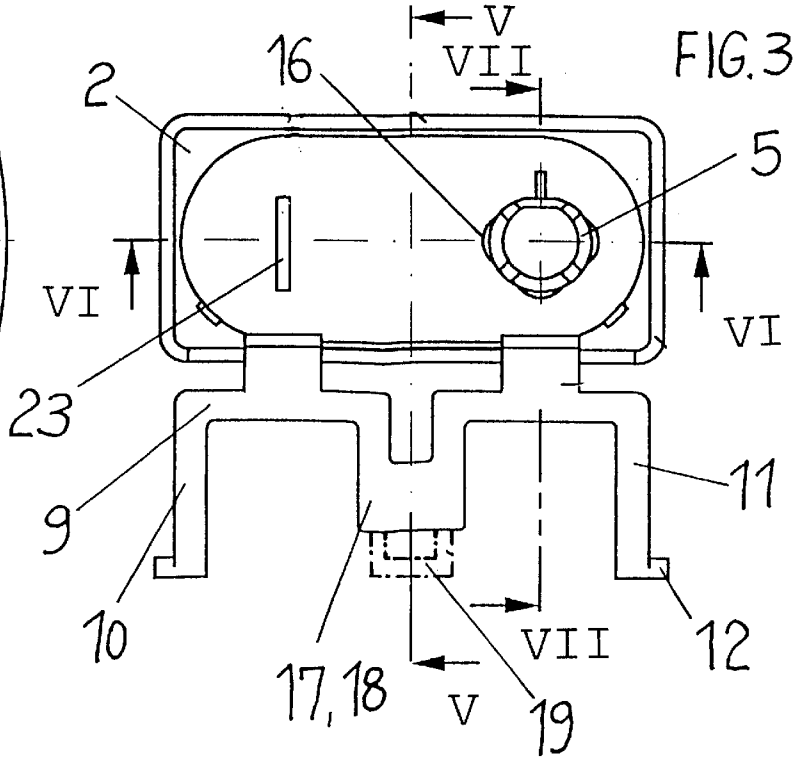
FIG. 3 is a bottom view of the large key.
Figure 4:
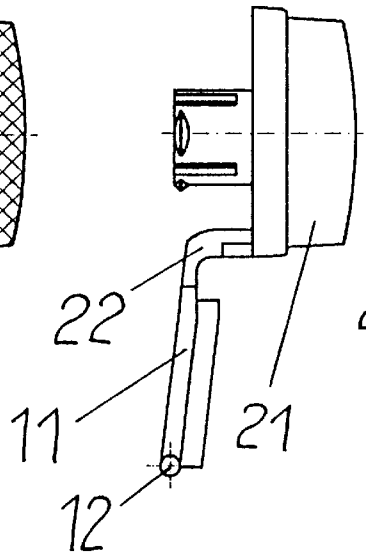
FIG. 4 is a side view of the large key, as seen from the right side of FIG. 3.
Figure 5:
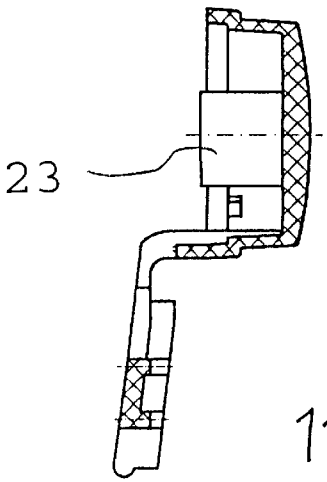
Figure 7:
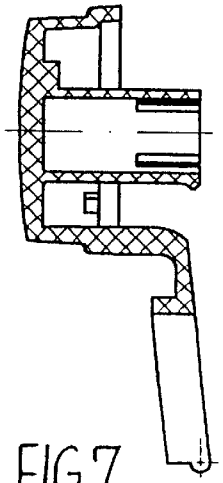

In a further development of the invention, the bearing fork projection 9 has a middle lever projection 17 that forms a guide section 18 between the guide bush pair 14, wherein the middle lever projection 17 can have a bearing section 19 that is received by a grip slot 20 located between the guide bush pair 14, as illustrated by the dotted lines in FIG. 3.

In order to stiffen the forked lever projections, the bearing fork projections 9 and 17 and a key body 21 have a common downward angle bend 22 that generally stabilizes the shape of the key 2.

It is provided that an adjacent guide bush, which forms a pair with the guide bush 6 in which the key ram 5 extends, receives a guide stem 23 of the key body 21, which can be seen in the plan view of the key in FIG. 3. This measure relieves loads acting on the bearing pins 12 and 19 in the grip slots 13 and 20 of the guide body 3.

With a key of this invention, an easy-to-install arrangement is provided that is structured as a single piece and allows a simple verification of assembly.

The invention claimed is:

1. A large key for covering several small key fields of a keyboard in an arrangement on a guide body, having a guide bush, of the keyboard for activating switching contacts, including switching foil, of the keyboard via a switching dome, said large key including a key ram for engaging the guide bush and cooperating with the switching dome and the switching foil positioned under the guide body for activating the switching contacts, wherein the large key has a bearing fork projection extending to a side of the key, said bearing fork projection including lever arms each of which has a bearing pin for engaging in a grip slot in the guide body, there being a grip slot positioned at each side of an adjacent guide bush pair, the key ram including a clip collar so that when the large key is pivoted to extend the key ram into the guide bush, the clip collar snaps over a protrusion ledge in the guide bush.

2. A large key as in claim 1, wherein the bearing fork projection has a middle lever projection forming a guidance section between the adjacent guide bush pair.

3. A key as in claim 2, wherein the middle lever projection has a bearing section for being received by a grip slot located between the adjacent guide bush pair.

4. A key as in claim 2, wherein the bearing fork projection and the key body have a common downward angle bend.

5. A key as in claim 1, wherein the large key has a guide stem and wherein a second guide bush forming a pair with the guide bush, in which the key ram is arranged, receives the guide stem of the key body.

* * * * *